US006347197B1

(12) United States Patent
Maul et al.

(10) Patent No.: US 6,347,197 B1
(45) Date of Patent: Feb. 12, 2002

(54) LIFE DETERMINATION IN AN OIL WEB SYSTEM

(75) Inventors: Michael David Maul; Edward Alan Rush; David William Shuman, all of Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 09/693,425

(22) Filed: Oct. 20, 2000

(51) Int. Cl.[7] ..... G03G 15/20
(52) U.S. Cl. ..... 399/24; 399/67; 399/325
(58) Field of Search ..... 399/24, 31, 33, 399/67, 324–327

(56) References Cited

U.S. PATENT DOCUMENTS 3,633,187 A 1/1972 Proctor et al.
4,215,921 A 8/1980 Miller et al.
4,217,615 A 8/1980 Suzuki
4,448,368 A 5/1984 Skalko
4,494,887 A 1/1985 Wincent
5,140,378 A 8/1992 Ibuchi et al.
5,267,401 A 12/1993 Freeman et al.
5,267,802 A 12/1993 Parnell et al.
5,991,562 A 11/1999 Ito et al.
5,995,772 A 11/1999 Barry et al.
6,070,044 A * 5/2000 Hoffmann et al. ..... 399/325
6,266,496 B1 * 7/2001 Rush et al. ..... 399/67

* cited by examiner

*Primary Examiner*—William J. Royer
(74) *Attorney, Agent, or Firm*—John J. McArdle, Jr.; Michael T. Sanderson; Todd T. Talyor

(57) ABSTRACT

An oil web system and method for operating a fuser system of an imaging apparatus in which remaining life of the oil web is determined from data on drive mechanism activation and data on web advancement lengths. A warning signal can be issued upon a predetermined remaining length being reached, and the machine can be disabled upon exhaustion of the web life.

26 Claims, 4 Drawing Sheets

LIFE DETERMINATION IN AN OIL WEB SYSTEM

BACKGROUND OF THE INVENTION

1. Field of the Invention

The present invention relates to an electrophotographic imaging apparatus, and more particularly to a fuser oiling apparatus life detection system in an electrophotographic imaging apparatus.

2. Description of the Related Art

In the electrophotographic process commonly used in imaging apparatus such as laser printers, an electrostatic image is created upon a photosensitive member such as a roll or belt. Visible electroscopic marking particles, commonly referred to as toner, are applied to the electrostatic image on the photosensitive material. Thereafter, the toner is transferred to the desired media, which may include paper, transparency sheets or the like.

Until the toner is fixed by the application of heat, the toner image applied to the media is not permanent. During fixing, the toner is elevated in temperature sufficiently to cause constituents of the toner to become tacky, and flow into the pores or interstices between fibers of the media. Upon cooling, the toner again solidifies, causing the toner to adhere to the media. Pressure may be applied to enhance the flow of the toner, and thereby improve the subsequent bonding of the toner to the media.

An approach used commonly for thermally fixing the electroscopic toner images is to pass the media, with the toner image thereon, through a nip formed by opposed rolls, at least one of which is heated either internally or externally such that the roll surface is at an elevated temperature. The heated roll, referred to as a fuser roll, contacts the toner image, thereby heating the image within the nip. Under some operating conditions, the tackiness of the toner upon heating can cause the media to adhere to the fuser roll and/or may cause a build up of toner on the fuser roll. By controlling the heat transfer to the toner, transfer of toner to the fuser roll can be minimized. In a duplex imaging apparatus, wherein both sides of the media may be printed, toner transfer or media sticking problems may be enhanced. Further, toner may be transferred to the backing roll of the fuser roll couple, and transferred thereafter elsewhere in the apparatus. The presence of wayward toner particles in the imaging apparatus can degrade the quality of the printed sheets.

In fusers of the type described, it is known to employ an apparatus for applying a release fluid to the surface of the fuser roll. The release fluid creates a weak boundary between the heated roll and the toner, thereby substantially minimizing the offset of toner to the fuser roll, which occurs when the cohesive forces in the toner mass are less than the adhesive forces between the toner and the fuser roll. Silicone oils, having inherent temperature resistance and release properties suitable for the application, are commonly used as release fluids. Polydimethylsiloxane is a silicone oil that has been used for this purpose advantageously in the past.

Various methods and apparatuses have been used to supply oil to the fuser hot roll, including oil wicking systems, oil delivery rolls, and oil webs. Oil wicking systems include reservoir tanks of the desired release agent or oil, and a piece of fabric wick material having one end mounted in the reservoir and the other end spring biased against the hot roll. Oil from the reservoir is drawn through the fabric wick by capillary action, and is deposited against the roll surface. While a wicking system can be effective in supplying oil to the fuser roll, surface deposit of the oil on the roll can be inconsistent, and the replenishment or replacement of the oil and/or system can be difficult and messy.

A variety of oil delivery roll systems have been used in the past, and include a roll nipped against the hot fuser roll. The oil delivery roll may be either freely rotating against the fuser roll or driven against the roll through a gear train. Oil delivered to the surface of the oil delivery roll is deposited on the hot fuser roll as the rolls rotate against each other. Various structures have been used for providing oil to the surface of the oil delivery roll, including reservoirs at the center of the roll providing oil to the surface through small dispersal holes or via capillary action through the outer material. Felts or metering membranes may be used in the oil delivery roll to control the oil flow through the roll. Another style of such roll is referred to as a web wrapped roll, and includes high temperature paper or non-woven material saturated with oil, and wrapped around a metal core. In yet another type of oil delivery roll, the roll rotates in a vat or reservoir of release oil, picking up a coating of the oil or release agent, which is then, in turn applied to the fuser roll. It is also known to use a roll couple in applying the oil from the vat onto the fuser roll. A first pickup roll rotates in the oil contained in the vat and is nipped against an applicator roll. The applicator roll is nipped against the fuser roll. Oil picked up by the pickup roll is transferred to the applicator roll, and is subsequently transferred to the fuser roll. Arrangements of this type can suffer from similar problems of resupply and cleanliness as oil wicking systems.

Oil web systems include a supply spool of web material, generally being a fabric of one or more layers saturated with the desired oil. Non-woven fabrics of polyester and aramid fibers, such as Nomex® manufactured by DuPont, have been used satisfactorily in oil web systems in the past. A take-up spool is provided for receiving the used web. A web path, commonly including one or more guide rolls, extends from the supply spool to the take-up spool. A portion of the web path brings the web material into contact with the hot fuser roll, either by wrapping a portion of the web around the hot roll, or by utilizing a spring-biased idler roll to nip the web material against the hot roll. As the hot roll rotates against the web in contact therewith, oil is transferred from the web to the fuser roll. Periodically, a drive mechanism for the take-up spool activates, rotating the take-up spool and advancing web material from the supply spool to the take-up spool, thereby bringing a fresh section of web material into contact with the fuser roll.

Oil web systems can be used to deliver oil with good uniformity across the fuser roll surface. However, oil deposits on the hot roll are dependent on the amount of web brought in to contact with the hot roll over a given period of time. Simplified drive mechanisms are known, for driving the take-up spool at a consistent interval and for a consistent time. As spent material accumulates on the take-up spool, the diameter of the spool grows, and the length of material brought in to contact with the hot roll increases if the web is indexed, or advanced, for a set duration at constant intervals. However, it has been difficult to determine the precise remaining life of an oil web system. Sheet counters have been used with some success; however, sheet count alone is not a precise indicator of oil web advancement. Indexing the oil web is not always consistent, and the requirements for oil application and web advancement may vary widely for different media types being printed. Unless complex algorithms are used which take in to consideration the media type being printed, sheet count alone can be quite inaccurate of the remaining unused web length. If the oil web runs out, and inadequate lubrication is provided during a printing job, print quality can be adversely affected, and more critically, damage may occur to fuser components. As a result, a preventative maintenance program may involve changing the oil web after a specified sheet count, which may occur with remaining useful life of the web still available, thus being wasteful. Sheet count is also not useful if a web oil system is removed, and later re-installed in the same or another system. Unless a dedicated sheet counter is supplied on the oil web unit, the sheet count is not preserved with nor transported with the oil web unit.

What is needed is a life determination system for an oil web unit of an imaging apparatus fuser drum which is automatic and accurate, and which can determine remaining web life even if indexing of the web is inconsistent, or if the oil web unit is removed from an imaging apparatus and then reinserted in the same or a different machine.

SUMMARY OF THE INVENTION

The present invention provides an imaging apparatus having an oil web system for applying release oil on the fuser roll, a sensor system, drive and control scheme with which oil web life may be determined based on the actual and contemporaneous operating data from the oil web system.

The invention comprises, in one form thereof, an oil web system in an imaging apparatus fuser having a fuser roll. The oil web system includes an elongated web having fuser roll release agent impregnated therein; a supply spool for holding an unused portion of the web and a take-up spool for holding a used portion of the web. A drive mechanism is operatively connected to the take-up spool for rotating the take-up spool. A web advancement sensor system is provided and generates data signals regarding linear web advancement. A controller activates and deactivates the drive mechanism. The controller is operatively connected to receive data signals regarding drive mechanism activation and the data signals regarding linear web advancement. The controller is adapted to process the data signals and determine remaining web life based on the data signals.

The invention comprises, in another form thereof, a method for operating an oil web system for a fuser roll in an imaging apparatus, including steps of providing a web carrying a release agent therewith, a supply spool for an unused portion of the web, and a take-up spool for a used portion of the web; extending the oil web from the supply spool to the take-up spool along a web path; rotating the take-up spool to draw web material along the web path from the supply spool to the take-up spool; operating a drive mechanism to perform the rotating step; generating a first data set related to actual linear web advancement; generating a second data set related to said operating step; and calculating a remaining length of unused web from said first data set and said second data set.

The invention comprises, in yet another form thereof, an imaging apparatus including a fuser having a fuser roll; a web oiling device operatively disposed to apply oil on the fuser roll, and including a web having oil therein, a supply spool and a take-up spool for the web. A drive mechanism is operatively connected for rotating the take-up spool. A first data signal generating device is provided for generating a first data set regarding linear advancement of the web. A second data signal generating device is provided for generating a second data set regarding operation of the drive mechanism. A drive mechanism controller is adapted to receive the data signals from the first and second data signal generating devices and to calculate a remaining web length from the first and second data signals. A signal pathway is provided between the drive mechanism controller and the drive mechanism.

The invention comprises, in still another form thereof, a method for determining the remaining length of an oil web in an oil web system having a supply spool, a take-up spool, a web path from the supply spool to the take-up spool and an intermittently operated drive mechanism causing advancement of the web from the supply spool to the take-up spool. The method comprises steps of obtaining a first data set regarding linear advancement of the web; obtaining a second data set regarding operating periods of the drive mechanism; and correlating said first data set and said second data set with a stored data set regarding remaining web lengths.

An advantage of the present invention is the consistent and accurate application of release fluid on the fuser roll, and point in life determination for an oil web system.

Another advantage of the present invention is that remaining life of the web can be determined accurately at any state during the life of the oil web system.

Yet another advantage of the present invention is that the life determination procedure is self contained with the oil web system, allowing a user to remove an oil web system and reinstall it, or exchange oil web systems between machines without affecting the accuracy of the remaining web life determination.

A further advantage of the present invention is that an advance warning of web life depletion can be given, allowing the user to be prepared for the need for replacement.

A still further advantage of the present invention is that web exhaustion can be determined, and the machine disabled, thereby preventing potential machine damage from an inadequate supply of release oil.

BRIEF DESCRIPTION OF THE DRAWINGS

The above-mentioned and other features and advantages of this invention, and the manner of attaining them, will become more apparent, and the invention will be better understood by reference to the following description of the embodiments of the invention, taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
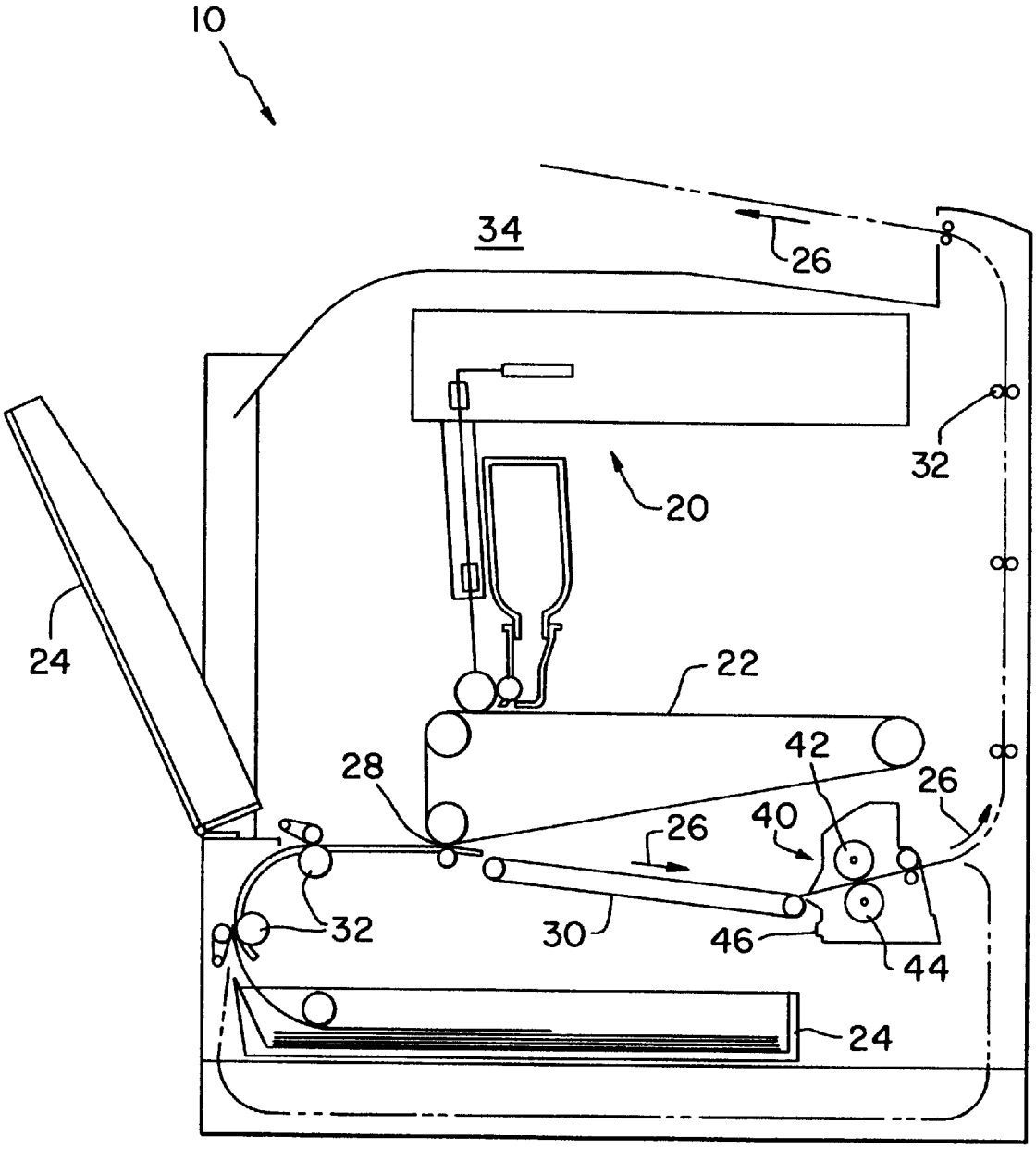
FIG. 1 is a simplified schematic representation of a laser printer in which the present invention may be utilized advantageously.
Figure 2:
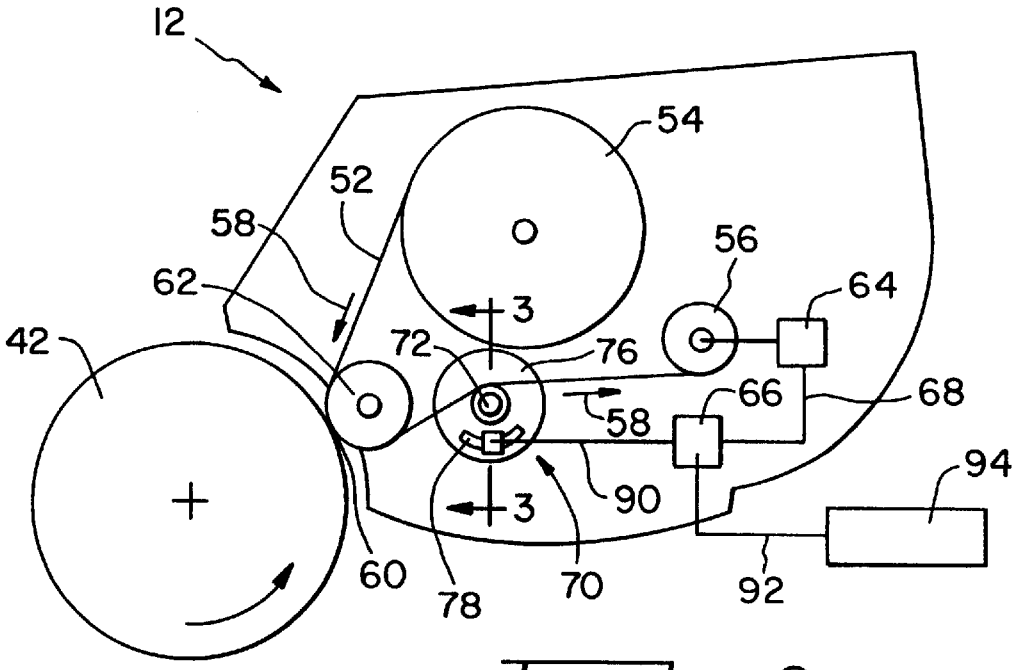
FIG. 2 is a schematic representation of an oil web system according to a preferred form of the present invention.

Referring now more specifically to the drawings, and to FIG. 1 in particular, numeral 10 designates an imaging apparatus in the form of a laser printer, in which an oil web system 12 of the present invention, shown in FIG. 2, may be used advantageously.

Laser printer 10, shown in FIG. 1, is merely one type of imaging apparatus in which the present invention may be used advantageously. Other types of imaging apparatuses, including other types and configurations of laser or other printers, may readily employ use of the present invention to achieve the advantages incumbent therein. The particular embodiment of the laser printer shown in FIG. 1 should not be construed as a limitation on the use and application of the present invention, nor on the scope of the claims to follow.

Laser printer 10 includes a laser printhead 20, which creates an electrostatic image in known fashion on a photosensitive member. Toner is applied to the electrostatic image. It should be understood that in a non-color printer only one printhead might be used; however, in a color printer separate printheads for black, magenta, cyan and yellow toners may be used. The toner image is created on a photoconductive drum and/or image transfer belt 22, and thereafter transferred to the selected media. The media, such as paper or the like, on which the image is to be printed, is provided from one or more media supply trays 24, two such media supply trays 24 being shown in FIG. 1. The media follows a media path, generally indicated by arrows 26, from one or the other of trays 24 through an image transfer nip 28, at which the image is transferred from the image transfer belt 22 to the media. Media path 26 may include processing through an associated duplexing side path, for reversing the sheet and bringing the opposite side of the media into image transfer nip 28 in proper orientation for receiving the transfer of an image thereto. Media path 26 includes a series of guide surfaces or belts 30, and guide rolls 32 to direct the media through the printer 10. A printed media-receiving zone 34 is provided at the end of the media path 26, to accumulate the completed pieces of media.

To fix the toner image on the media, a fuser 40 is provided, to apply heat and pressure to the image on the media, thereby causing the toner to melt and flow into the pores or interstices of the media. Fuser 40 includes a hot roll 42 and a backing roll 44 creating a fuser nip 46 through which the media passes. To prevent paper from sticking to hot roll 42, and to minimize toner offset to the hot roll, oil web system 12 is provided, to apply a release agent, such as silicone oil, to the surface of hot roll 42.

Those skilled in the art will understand readily the structure and operation of a laser printer as thus far described, and further details thereof are not necessary to an understanding of the present invention, and will not be given further herein.

Referring now to FIG. 2, oil web system 12 includes a web 52 of suitable material for carrying release agent. A non-woven fabric of polyester and aramid fibers, such as Nomex® manufactured by and available from DuPont, has been used advantageously in the past. The material is coated or saturated with a release agent, such as silicone oil of polydimethylsiloxane or the like. Web 52 is a relatively thin elongated band stored on a supply spool 54 prior to its use in oil web system 12. A take-up spool 56 is provided for receiving used or spent portions of web 52. Between supply spool 54 and take-up spool 56, web 52 extends along a web path designated by arrows 58. Web guiding members, including supply spool 54, take-up spool 56 and other guide rolls or guide surfaces, define the web path. Along at least a portion of the web path, web 52 is brought into contact with hot roll 42 of fuser 40. Release agent is transferred from web 52 to hot roll 42 at an oil transfer nip 60. In the embodiment shown, oil transfer nip 60 is created by the close proximity of a spring-loaded biasing roll 62 to hot roll 42, which holds web 52 against hot roll 42 at oil transfer nip 60. It should be understood that other arrangements could be used advantageously to bring portions of web 52 into contact with hot roll 42. For example, two or more rolls may be used to position web 52 such that a segment of web 52 wraps a portion of hot roll 42. Alternatively, the relative positions of a single idler roll and take-up spool 56 may be such as to cause a portion of web 52 to wrap a portion of hot roll 42.

In oil transfer nip 60, or other transfer area at which oil is deposited on hot roll 42, the surface of hot roll 42 and web 52 move in opposite directions. Tension is applied to web 52 between biasing roll 62 and take-up spool 56, and, therefore, roll up of web 52 on take-up spool 56 is under tension. Wound-in tension creates a neat, clean wind up of the material on take-up spool 56. Further, tension is relieved from the segment of the web 52 between supply spool 54 and biasing roll 62, to prevent unintentional unwind from supply spool 54, and any resultant foul-up of web 52, or over application of oil on hot roll 42.

To effect transfer of web 52 from supply spool 54 to take-up spool 56, a drive mechanism 64 is provided, connected to take-up spool 56 for rotation thereof to draw web from supply spool 54. Drive mechanism 64 may include an independent, dedicated prime mover and gear train, a gear train from a common drive for other apparatus in printer 10, a direct drive prime mover, or the like. The prime mover may be a stepper motor, a solenoid, or other positional activator. Such drive mechanisms are known in the industry, and will not be described in further detail herein. Operation of drive mechanism 64 is controlled by a drive controller 66, which transmits signals to drive mechanism 64, including start and stop signals along a signal transmission pathway 68. Drive controller 66 may include a microprocessor, and other digital or analog control components, and signal transmission pathway 68 is suitable for sending control signals to drive mechanism 64. Drive controller 66 may be connected to receive additional signal inputs relating to the media type being used, the desired print characteristics and the like, to determine need for oil web advancement. Controller 66 also may include counter means for tracking the number of drive mechanism operations.

In accordance with the present invention, a web advancement sensor system 70 is provided, and includes an idler shaft 72, properly journaled in bearings, low friction bushings or the like (not shown). A web engagement portion 74 of shaft 72, such as a sleeve, boss, knurl, shoulder portion of shaft 72, or the like, is positioned to be in contact with, and partially wrapped by web 52. Advantageously, web advancement sensor system 70 is disposed along that segment of web 52 between take-up spool 56 and biasing roll 62, that segment along which there is tension in web 52. Since web 52 partially wraps engagement portion 74, as web 52 advances along the path, idler shaft 72 of web advancement sensor system 70 is rotated in direct proportion to the linear movement of web 52.

Figure 3:
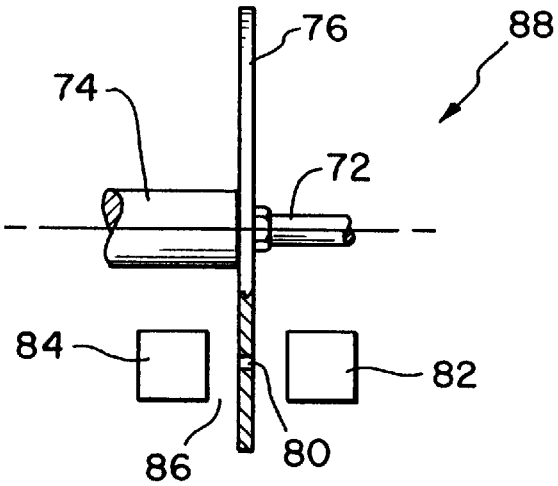
FIG. 3 is a cross-sectional view of the oil web system shown in FIG. 2, taken along line 3—3 of FIG. 2.

An encoder wheel 76 is disposed on idler shaft 72 or engagement portion 74, for rotation therewith. Encoder wheel 76 includes surface indicia; holes or the like, movement of which may be detected by an appropriate sensor. In the embodiment shown, a band or region 78 is provided near the periphery of the encoder wheel 76. Within band or region 78, a hole or opening 80 (FIG. 3), or a plurality thereof are provided, and may be in specific patterns or orientations. Although band or region 78 is shown as only a segment on wheel 76, it may extend along a greater portion or entirely around encoder wheel 76, near the periphery thereof. A transmissive sensor, including an emitter 82 and a receiver 84, is used to detect movement of encoder wheel 76, as evidenced by the passage of hole or holes 80 through a region 86 between emitter 82 and receiver 84. The structures and operations of appropriate sensors that may be used in the present invention, to ascertain the pattern or frequency of hole passings, are known for other uses, will not be described in further detail herein and will be referred to as an encoder wheel sensor 88. Data signals from encoder wheel sensor 88 are transmitted along a suitable signal pathway 90 to drive controller 66, which is further connected by a signal pathway 92 to an operator panel 94, other print manager devices such as printer software on a PC or network shown schematically as a box in FIG. 2. It should be understood that operator panel 94 will be located at or near the top and or front of printer 10, at a location readily apparent and accessible to a user of printer 10, and much of the remaining features shown in FIG. 2 are located internally of printer 10. Operator panel 94 may include a user-input pad, various warning and indicator lights, a text message display area and the like. Those skilled in the art will understand readily that by establishing a connection via signal pathway 92 to printer software on a personal computer, or network, messages may be generated also on a computer monitor.

Other types of web movement sensors may be used advantageously in the present invention. The encoder wheel 76 and encoder wheel sensor 88 shown and described are not the only suitable sensors, but are a preferred, low cost and accurate alternative.

Figure 4:
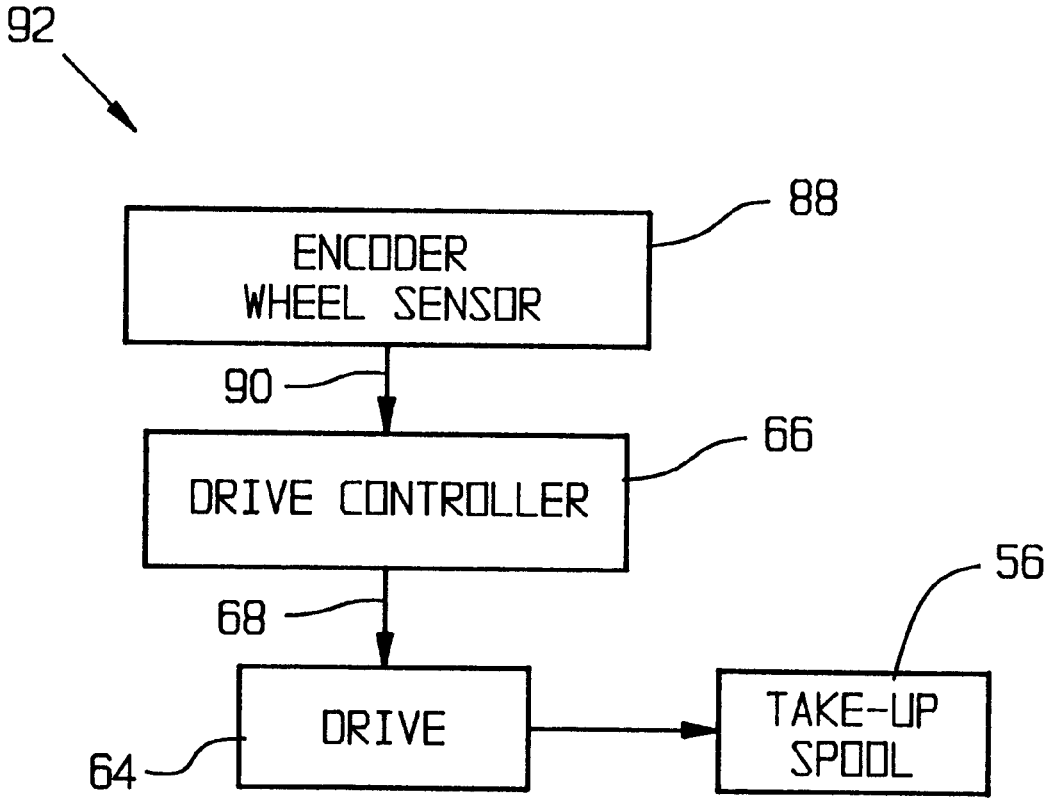
FIG. 4; is a flow diagram of a basic drive control scheme for an oil web system according to the present invention.

The frequency of advancement or indexing of web 52 is determined by pre-stablished parameters in drive controller 66. Determination of the need for web advancement may include consideration of information regarding the type of media being printed, user input print quality requirements, etc. When a determination is made that oil web advancement is required, drive controller 66 activates drive mechanism 64, to rotate take-up spool 56. Web 52 is drawn from supply spool 54, through oil transfer nip 60, and spent portions of web 52 are wrapped onto take-up spool 56. As web 52 is advanced along that segment of the web path between biasing roll 62 and take-up spool 56, web 52 passes over and rotates idler shaft 72, and thereby encoder wheel 76. As encoder wheel 76 rotates, and holes 80 pass through region 86 between emitter 82 and receiver 84, data related to the passing of holes 80 is transmitted along signal pathway 90 to drive controller 66, in known manner. Using data from encoder wheel sensor 88, drive controller 66 terminates the drive signal to drive mechanism 64, stopping advancement of web 52 when the desired length of web 52 has moved along the web path. In another operating routine, a predetermined number of encoder wheel "signals" is known for the desired web advancement length. Drive mechanism 64 is operated for a pre-established time, or number of steps in the case of a stepper motor. By comparing actual performance in a number of previous operations, prediction is made for the next operation of drive mechanism 64 to achieve the necessary encoder wheel signals. This determination is made independent of the angular movement of take-up spool 56. In this manner, regardless of the diameter of take-up spool 56, a consistent, specified, or predetermined length of web 52 is advanced during each indexing step. The linear advancement of web 52 can remain constant, for any diameter of take-up spool 56 throughout, the duration of the life of oil web system 12. A general drive control scheme 92 for operation of oil web system 12 is shown in FIG. 4.

Through operation of encoder wheel sensor 88, controller 66 receives data regarding actual linear advancement of the web. Coupled with data regarding the operation of drive mechanism 64, the information regarding actual linear advancement can be used for determining the remaining amount of web 52 on supply spool 54, and the remaining life of oil web system 12. The present invention provides a closed loop control that enables accurate indexing and web life determination, regardless of the state of life of the web, and independent of web system removal or swapping between machines. As the amount of web material on the take-up spool increases, in order to increment the required web advancement distance, the number of steps required of a stepped drive, such as a stepper motor, decreases. By comparing the steps required of the drive, to the actual linear advancement distance of the web, a determination can be made of the life state of the web. As a general comparison, if drive mechanism 64 activates many times or for a long period of time to advance web 52 a given distance, web system 12 is relatively new, and take-up spool 56 is smaller in diameter, requiring greater rotation to move web 52 the required distance. Conversely, if drive mechanism 64 activates only a few times or for a short time period to advance web 52 the same given distance, web system 12 is old, and take-up spool 56 is large in diameter, requiring less rotation to move web 52 the required distance.

The closed loop system provided by web advancement sensor system 70, drive mechanism 64 and drive controller 66 allows for direct determination of the life state of oil web system 12; however, it is more practical to determine stages in the life of web system 12. At a given indexing ratio between counts of drive mechanism 64 and counts of encoder wheel 76, a known length of web 52 remains. After the specified ratio has been reached, for each subsequent activation of web system 12, the known linear length of web 52 advanced is subtracted from the remaining length. At specific remaining lengths, warning signals can be issued, and ultimately the machine stopped when all remaining web 52 has been used.

Figure 5:
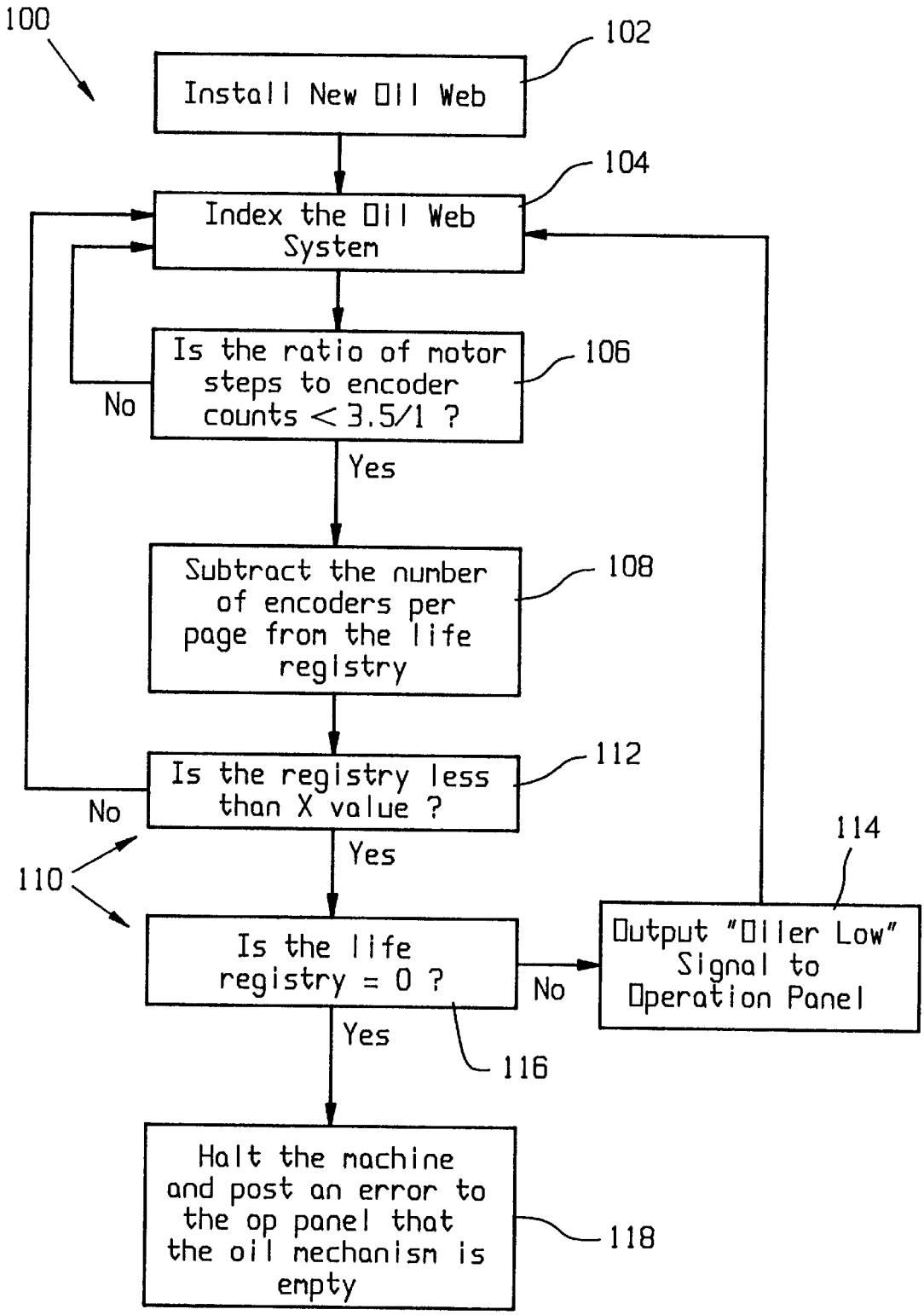
FIG. 5 is a flow diagram of a web life determination control scheme of the present invention.

FIG. 5 illustrates a control scheme 100 for use with a stepper motor as the prime mover in drive mechanism 64. Control scheme 100 is operable upon an installation 102 of an oil web system 12 in fuser 40. Upon determination by drive controller 66 of the need therefor, an oil web system indexing step 104 is initiated, that is, drive mechanism 64 is activated, rotating take-up spool 56 and drawing a length of material web 52 along web path 58 from supply spool 54. As the web is advanced, idler shaft 72 is rotated, turning encoder wheel 76. Controller 66 determines the actual length of material web 52 advancement from information received from web advancement sensor system 70, generating a first data set regarding linear web advancement. Controller 66 also determines and tracks, from drive mechanism 64, data regarding the number of stepper motor "steps" required to cause the determined linear advancement, each such stepper motor step occurring as a result of a signal from drive controller 66 along signal pathway 68. Controller 66 thereby generates a second data set regarding operation of drive mechanism 64. In a comparison step 106, using the first and second data sets, the ratio of stepper motor steps to encoder counts is determined, which may be an average over several recent indexings, and the ratio is compared against a pre-established or target ratio. If the pre-established target ratio is not met or surpassed, no further action is required or taken, and subsequent web indexings occur as described above.

When comparison step 106 determines that the pre-established target ratio of stepper motor steps to encoder counts has been reached, a remaining life calculation step 108 is entered. In the example shown in FIG. 5, the target ratio of 3.5 stepper motor steps to encoder counts has been used, which, when reached, indicates a known remaining length of web 52 on supply spool 54. When the ratio becomes less than 3.5/1, the diameter of take-up spool 56 is large, and the remaining web life is short. For each subsequent activation of oil web system 12 after the target ratio has been reached, the length of web 52 which is advanced along web path 58, as determined by drive controller 66 from data received from web advancement sensor system 70, is subtracted from the known remaining length of web 52. In a multiphase length comparison step 110, the calculated remaining length is compared to predetermined target lengths. In comparison step first phase 112, if a first target length is reached, a warning signal 114 is issued, which may be visible as a warning light illumination or text message given at operator panel 94 of printer 10 or sent to a connected personal computer or to other software components of printer 10 for an appropriate warning display. In the case of a network printer, a suitable warning message may be sent to network operating personnel. Oil web system 12 and drive control scheme 92 continue to function, as required. Advance warning of imminent web exhaustion allows the user to prepare by obtaining a replacement oil web system 12, or by contacting a competent repair service, and scheduling service so as not to interrupt unduly the use of printer 10. A single such warning message may be given, or as the remaining life of web 52 decreases, subsequent messages may increase in criticality of the message conveyed. Ultimately, as the web life reaches exhaustion, a second phase 116 comparison to zero will be answered "yes" and a shutdown command signal 118 is issued, to disable continued operation of printer 10 and prevent damage to printer 10, which may occur otherwise from inadequate release oil application on hot roll 42.

Life determination in accordance with the present invention is independent of whether an oil web system 12 is removed and subsequently reinstalled in the same or another printer 10. Upon each activation of web system 12, the calculations are made as shown in and described for FIG. 5. As such, an oil web system 12 may be removed from one machine and placed in another without the need for resetting page count systems or the like. When an oil web system 12 is installed, life determination begins accurately and automatically, without installer input. System 12 also prevents inadvertent operation of printer 10 after oil web system 12 has been depleted.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An oil web system in an imaging apparatus fuser having a fuser roll, the oil web system comprising:

an elongated web having fuser roll release agent impregnated therein;

a supply spool for holding an unused portion of said web;

a take-up spool for holding a used portion of said web;

a drive mechanism operatively connected to said take-up spool for rotating said take-up spool;

a web advancement sensor system generating data signals regarding linear web advancement; and a controller for activating and deactivating said drive mechanism, said controller being operatively connected to receive data signals regarding drive mechanism activation and said data signals regarding linear web advancement, and said controller being adapted to process said data signals and determine remaining web life based on said data signals regarding drive mechanism activation and linear web advancement.

2. The oil web system of claim 1, further comprising an operator panel for receiving a warning message regarding remaining web life, and a signal pathway between said operator panel and said controller.

3. The oil web system of claim 2, wherein said web advancement sensor system includes an encoder wheel driven by movement of said web.

4. The oil web system of claim 1, wherein said web advancement sensor system includes an encoder wheel driven by movement of said web.

5. A method for operating an oil web system for a fuser roll in an imaging apparatus, comprising the steps of:

providing a web carrying a release agent therewith, a supply spool for an unused portion of the web, and a take-up spool for a used portion of the web;

extending the oil web from the supply spool to the take-up spool along a web path;

rotating the take-up spool to draw web material along the web path from the supply spool to the take-up spool;

operating a drive mechanism to perform said rotating step;

generating a first data set related to actual linear web advancement;

generating a second data set related to said operating step; and calculating a remaining length of unused web from said first data set and said second data set.

6. The method of claim 5, further comprising determining from said calculating step when a first target web length remains, and issuing a warning signal in response thereto.

7. The method of claim 6, further comprising determining from said calculating step when a second target web length remains, and disabling the imaging apparatus in response thereto.

8. The method of claim 5, further comprising determining from said calculating step that no usable web length remains, and disabling the imaging apparatus in response thereto.

9. The method of claim 5, further comprising providing an encoder wheel positioned to be moved by linear advancement of the web, and sensing movement of the encoder wheel for said step of generating a first data set.

10. The method of claim 9, further comprising providing a stepper motor in the drive mechanism, and said step of generating a second data set includes ascertaining stepper motor steps during web advancement.

11. The method of claim 10, further comprising determining a ratio of stepper motor steps to linear advancement distance of the web, and comparing said ratio to a target ratio.

12. The method of claim 11, further comprising issuing a warning signal in response to said comparing step determining the target ratio has been reached.

13. The method of claim 11, further comprising determining an actual linear advancement distance of the web, and deducting the actual linear advancement distance from a pre-established remaining web distance for each said operating step after said comparing step has determined the target ratio has been reached.

14. The method of claim 13, further comprising issuing a warning signal in response to said comparing step determining the target ratio has been reached.

15. The method of claim 14, further comprising determining from said calculating step that no usable web length remains, and disabling the imaging apparatus in response thereto.

16. The method of claim 5, further comprising providing a stepper motor in the drive mechanism, and said step of generating a second data set includes ascertaining stepper motor steps during web advancement.

17. An imaging apparatus comprising:

a fuser having a fuser roll;

a web oiling device operatively disposed to apply oil on said fuser roll, and including a web having oil therein, a supply spool and a take-up spool for said web;

a drive mechanism operatively connected for rotating said take-up spool;

a first data signal generating device for generating a first data set regarding linear advancement of said web;

a second data signal generating device for generating a second data set regarding operation of said drive mechanism;

a drive mechanism controller adapted to receive said data signals from said first and second data signal generating devices and to calculate a remaining web length from said first and second data signals; and a signal pathway between said drive mechanism controller and said drive mechanism.

18. The imaging apparatus of claim 17, further comprising an encoder wheel disposed for rotation by linear advancement of said web.

19. The imaging apparatus of claim 18, wherein said drive mechanism includes a stepper motor.

20. The imaging apparatus of claim 19, further comprising warning signal means connected to said drive mechanism controller.

21. The imaging apparatus of claim 17, further comprising warning signal means activated by said drive mechanism controller.

22. The imaging apparatus of claim 17, wherein said drive mechanism includes a stepper motor.

23. A method for determining the remaining length of an oil web in an oil web system having a supply spool, a take-up spool, a web path from the supply spool to the take-up spool and an intermittently operated drive mechanism causing advancement of the web from the supply spool to the take-up spool, said method comprising steps of;

obtaining a first data set regarding linear advancement of the web;

obtaining a second data set regarding operating periods of the drive mechanism; and correlating said first data set and said second data set with a stored data set regarding remaining web lengths.

24. The method of claim 23, further comprising steps of determining from said correlating step when a target web length remains, and issuing a low web length warning in response thereto.

25. The method of claim 24, further comprising the steps of determining from said correlating step when no useful web length remains, and deactivating the imaging apparatus in response thereto.

26. The method of claim 23, further comprising the steps of determining from said correlating step when no useful web length remains, and deactivating the imaging apparatus in response thereto.

* * * * *